US005167111A

United States Patent [19]

Cottenceau et al.

[11] Patent Number: 5,167,111

[45] Date of Patent: Dec. 1, 1992

[54] UNIVERSAL METHOD TO UNTWIST, UNRAVEL AND OPEN UP A TEXTILE YARN

[75] Inventors: Rémi Cottenceau, Viry, France; Erwin Zuercher, Le Lignon, Switzerland

[73] Assignee: Mesdan S.p.A., Salo, Italy

[21] Appl. No.: 218,857

[22] Filed: Jul. 14, 1988

[30] Foreign Application Priority Data

Jul. 15, 1987 [CH] Switzerland ..... 2702/87
May 16, 1988 [CH] Switzerland ..... 1834/88

[51] Int. Cl.[5] ..... D01H 15/00

[52] U.S. Cl. ..... 57/1 UN; 57/22; 57/350

[58] Field of Search ..... 57/1 UN, 22, 23, 261, 57/262, 263, 350, 908; 28/274

[56] References Cited

U.S. PATENT DOCUMENTS 3,478,398 11/1969 Barlow et al. ..... 28/274
3,962,855 6/1976 Stahlecker ..... 57/263
4,408,442 10/1983 Rohner ..... 57/22
4,549,392 10/1985 Kimura ..... 57/22
4,653,260 3/1987 Artzt et al. ..... 57/23 X
4,757,678 7/1988 Stahlecker ..... 57/263

FOREIGN PATENT DOCUMENTS 0053093 6/1982 European Pat. Off. .

*Primary Examiner*—Joseph J. Hail, III
*Attorney, Agent, or Firm*—Cushman, Darby & Cushman

[57] ABSTRACT

The method involves the use of two nozzles (5 and 6) which alternatively blow air jets against a yarn in the central portion of a channel (1), these nozzles being symmetrically placed in relation to a plane containing the channel axis. The jets blowing frequency is of several hundreds of Hz. A deflector (3) in the bottom of channel (1) can deviate the beating thread sidewise and consequently impart thereto alternate twisting and untwisting motion in order to unravel the thread.

5 Claims, 2 Drawing Sheets

UNIVERSAL METHOD TO UNTWIST, UNRAVEL AND OPEN UP A TEXTILE YARN

FIELD OF THE INVENTION

The present invention concerns a universal method for loosening, unravelling and opening up a textile yarn by putting the free end of this yarn in a pressurized, channelled air stream, and by holding the base of this free end in the upstream portion of this air stream. This invention also concerns a device for embodying the method.

BACKGROUND OF THE INVENTION

Various pneumatic means have already been proposed to loosen and unravel textile yarns. For instance, devices are known which comprise a channel in which the yarn to be untwisted is placed and in which one or two tangential jets are blown and generate a swirl for untwisting a yarn as disclosed in U.S. Pat. No. 4,408,442. A device is known, as disclosed in U.S. Pat. No. 4,549,392, to loosen textile yarns which comprises a cylindrical channel for receiving the thread and in which an air jet is injected and directed against a baffle plate located in the channel and capable of forming two symmetrically oriented but counter-rotating whirls. Depending on its twist configuration the yarn is subjected to one or the other of the whirls in order to be untwisted.

It is known that with many kinds of yarn, namely open end or ply yarn, untwisting is not sufficient to achieve unravelling because the fibers are not all uniformly twisted and, in some cases e.g. with ply yarns, they are twisted in opposite directions. In this case, it is not readily possible to loosen, unravel and open up the yarn end by a pneumatic untwisting operation. It is known now that unravelling and opening up the ends of yarns to be spliced together is essential for obtaining appropriate strength and good visual aspect of the spliced yarn. It has been noted in this connection that if the ends of hard-to-untwist yarns are subjected to a pneumatic action limited to an untwisting and pulling effect, the desired result is not attained. Indeed, if a blocking effect occurs, because for instance the fibers are not parallel like in an open-end yarn, the uni-directional untwisting action is not effective to loosen the blocked fiber portion and the pull constantly applied to the end tends to further tighten the fibers in the blocked portion.

Consequently, the various proposed solutions are inadequate to properly settle this problem.

Another solution still exists, from EP-A-0.053.093, in which it is proposed to subject the thread to vibrations for reducing the friction between the fibers and for decreasing the risks of blockage. For this, one vibrates a flexible element in an air stream. This route gives results but still has limits. Furthermore, the vibrating element may wear out with time and should be periodically replaced.

SUMMARY OF THE INVENTION

The object of the present invention is to remedy, at least in part, the foregoing shortcomings.

One object of the invention is a method to loosen, unravel and open up a textile yarn. Another object is the provision of a device for overcoming the problems in the prior art.

The advantages of this invention are important as all kinds of yarns can be loosened with the same apparatus. No moving part is involved, which means no wear and maintenance. The construction of the device is simple, it is not cumbersome and it can be integrated into existing splicing equipment.

BRIEF DESCRIPTION OF THE DRAWINGS

The annexed drawing illustrates schematically, and as examples, two embodiments of the device for implementing the method of the invention.

DETAILED DESCRIPTION OF THE INVENTION

Figure 1:
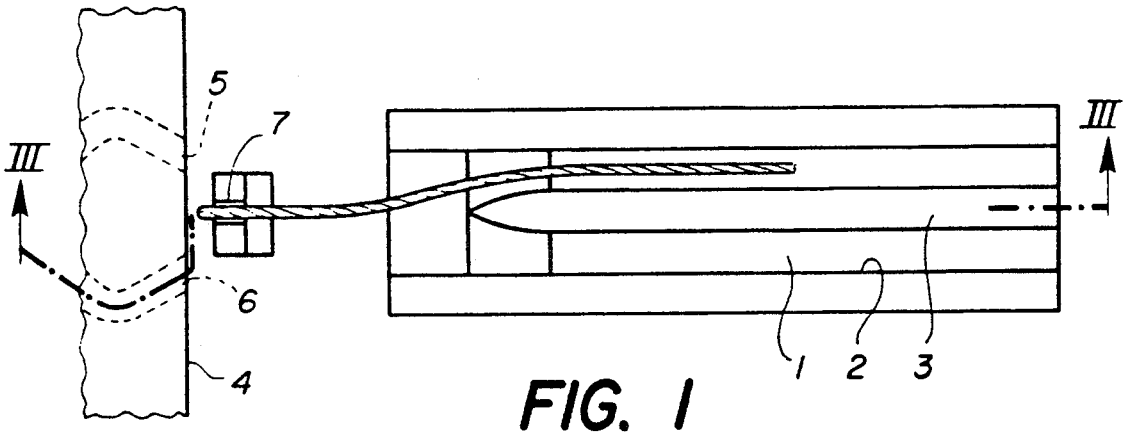
FIG. 1 is a view from above of a first embodiment.

The device illustrated in FIG. 1 comprises a duct 1 opened at both ends and also sidewise through a longitudinal opening 2. The bottom of this channel contains a deflector 3 to be discussed later.

Figure 3:
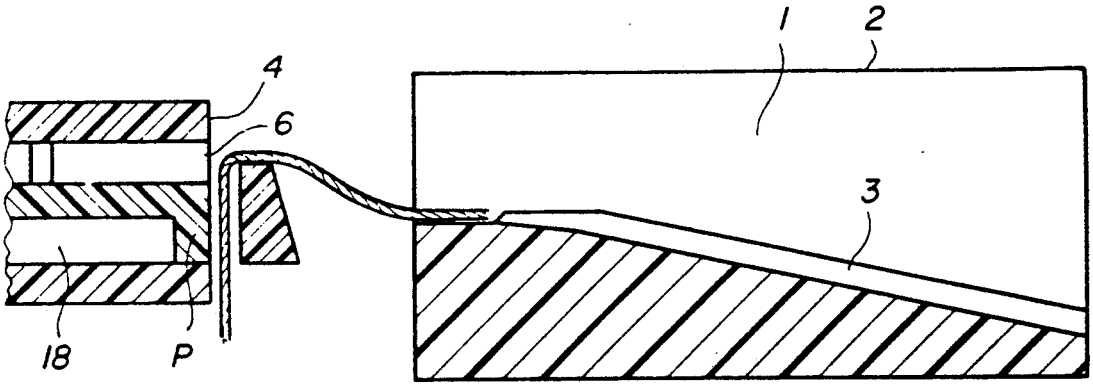
FIG. 3 is a cross-sectional view along line III—III of FIG. 1.

FIG. 3 shows the longitudinal profile of the bottom of channel 1 with three parts having different slopes.

Figure 2:
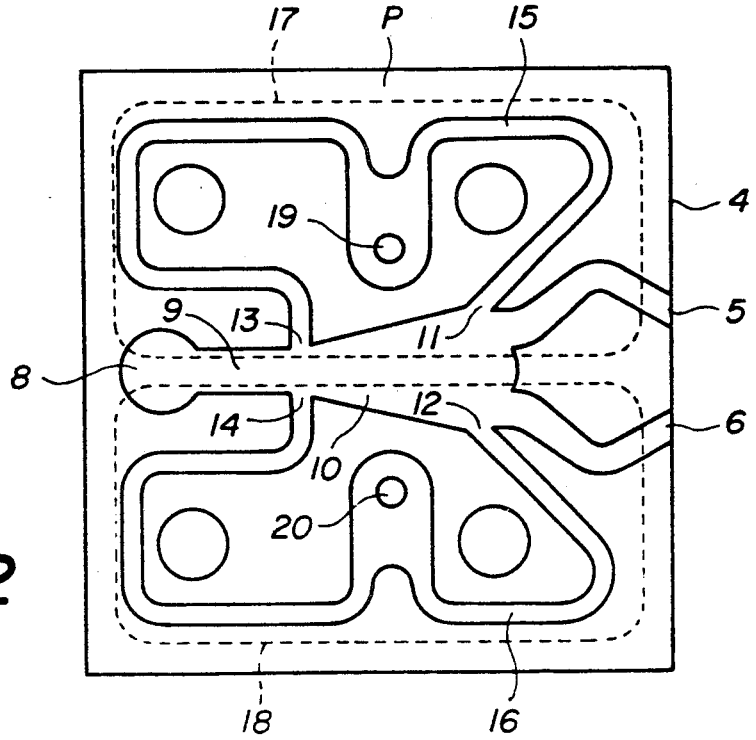
FIG. 2 is an enlarged detailed view of the generator which produces jets in alternation.

The air-jet generator is placed in facing relation with one of the channel's ends. This generator is provided with two nozzles 5 and 6 disposed on both sides of the central axis of channel 1 which also corresponds to the position of the yarn as determined by a notch 7. This generator consists of a flip-flop fluid circuit, illustrated in detail in FIG. 2, connected to a source of pressurized air (not shown). This flip-flop fluid circuit is housed in a plate P provided on one of its faces with an air inlet 8 to be directly connected to the source of pressurized air. A channel 9 opens into a passage 10 which widens and divides into two nozzles 5 and 6. Each end of this enlarged passage 10 communicates with two side openings 11, 12, at one end and 13, 14 at the other end. Openings 11, 13, and 12, 14 respectively constitute two ends of respective conduits 15 and 16 forming two loops which close on the enlarged passage 10. Each loop 15, 16 further comprises, in series or in parallel (here in parallel), a fluid capacitor formed by a respective compartment 17, 18, located on the other side of the plate and connected respectively thereto by two calibrated holes 19, 20 which act as resistors. Plate P is sandwiched between two other plates, which are applied against the faces in which the fluid circuit is managed, and is secured by means of screws passing through some openings (not shown) in plate P in order to isolate the circuit from the outside. The plate which covers the upper face of the plate P in FIG. 2 is provided with a passage to connect together the air input 8 and the pressurized air source.

When the fluid flip-flop circuit is supplied with pressurized air through input 8, this air flows against one of the wedge-shaped walls defining passage 10. Then this air penetrates into nozzles 5, 6 which extends the walls against which air flows; however, a portion of this air also penetrates into conduit 15 or 16 through opening 11 or 12 adjacent to the nozzles 5, 6 and the remainder of the pressurized air escapes therefrom. When this air passing through conduit 15 or 16 leaves opening 13 or 14, it deflects the jet exiting from channel 9 toward the other wall of the wedge-shaped passage 16. The same sequence of events then occurs on said opposite wall, which means that the air jets alternately spout from nozzles 5 and 6, the swing frequency of the flip-flop being controlled by the time the air travels from one entrance opening 11, 12 and one exit port 13, 14; the duration of this time is controlled by the value of capacitance 17, 18 and the resistance 19, 20, so the flip-flop frequency can be adjusted. The simplicity of this device with no movable part 8, which requires no maintainance while keeping perfectly stable, is obviously an enormous advantage of the invention.

In order to loosen, unravel and open up a yarn with the foregoing device, one places the front end of channel 1 at a distance of about 10 mm from the nozzles 5 and 6, the upstream portion of the channel 1 being approximately horizontal. A length of about 2 cm of the thread is introduced beyond notch 7 which correctly positions the thread in the device; then the flip-flop circuit is started with air under a pressure of 0.2 to 0.5 MPa for a few tenths of a second. Observation of the thread with a stroboscope indicates that the free end of the yarn rests very near the end of the channel 1 and, under the swinging action of nozzles 5 and 6, it moves back and forth from one side of the channel to the other side thereof. Because of the presence of the deflecting baffle 3 in the bottom of this channel, the yarn rubs against this baffle when moving from one side to the other side of the channel which, because of the lateral bending motion to which it is subjected, imparts thereto a slight twisting, respectively untwisting, motion which results into it being unravelled; this motion is combined with a variation of the stress imposed to the wire, as the pressure signals leaving nozzles 5 and 6 are substantially sine waved.

Although the presence of deflecter 3 contributes to improve the efficiency of the method in many cases, it seems not to be absolutely necessary, inter alia in cases where the yarn is very thin, whereby, because of a very small inertia, it will constantly remain within the air stream and will not contact the channel's walls, even when the stream abruptly changes direction.

The different parameters involved in the operation of the method are now studied.

The several experiments were achieved with a channel 35 mm long, 6 mm wide and a deflector 3 2 mm thick starting 3 mm from the upstream end with a part sloped at 45° and the thickness of which decreases in the direction of the upstream end of this deflector along a distance of 0.2 to 0.5 mm. The bottom of the channel above the deflector 5 in the upstream direction is horizontal; its next middle portion has a slope of 10° and is followed by a down stream portion with a slope of 20° along which the height of the deflector increases.

The nozzles 5 and 6 are disposed approximately 2 mm above the level of the upstream portion of channel 1. The flip-flop circuits used to perform these experiments have frequencies of from 800 to 1300 Hz. In the next Table, different yarns are mentioned which were loosened, unravelled and opened up with the method and the device of the invention as previously described. The process duration is from 0.1 to 0.5 sec.

TABLE

| Type of fibers | metric numbers | direction of torsion | Spinning mode | Frequency of flip-flop (Hz) |
|---|---|---|---|---|
| acrylic | 8.2 | Z | AC | 900–1200 |

TABLE-continued

| Type of fibers | metric numbers | direction of torsion | Spinning mode | Frequency of flip-flop (Hz) |
|---|---|---|---|---|
| wool | 5.3 | Z | AC | 1200–1300 |
| acrylic H.B. | 40/2 | S + Z | AC | 900 |
| cotton | 12 | S | OE | 1000 |
| acrylic-wool | 21 | Z | AC | 900 |
| cotton | 40/2 | S + Z | AC | 1000 |
| wool | 40/2 | S + Z | AC | 1000 |
| cotton | 10 | Z | AC | 800 |
| cotton | 8 | Z | AC | 800 |
| polynosic | 8 | Z | AC | 1200–1300 |
| acrylic | 34 | Z | AC | 900 |
| cotton | 50 | Z | AC | 1000 |
| cotton | 70 | Z | AC | 1000 |

*AC = ring spinning; OE = open-end

This table shows the capacity of the method to untwist samples of all kinds of yarns. In general, an excellent opening-up of the yarns subjected to the present method has been observed which is an essential condition to good splicing. The side deflection imparted to the yarn by passing over the deflector 3 produces alternate twisting and untwisting effects to the yarn which, due to its being in synchronism with a modulation of the pull on the yarn as given by the alternating jets, are more efficient than that of a simple yarn oscillation.

Figure 4:
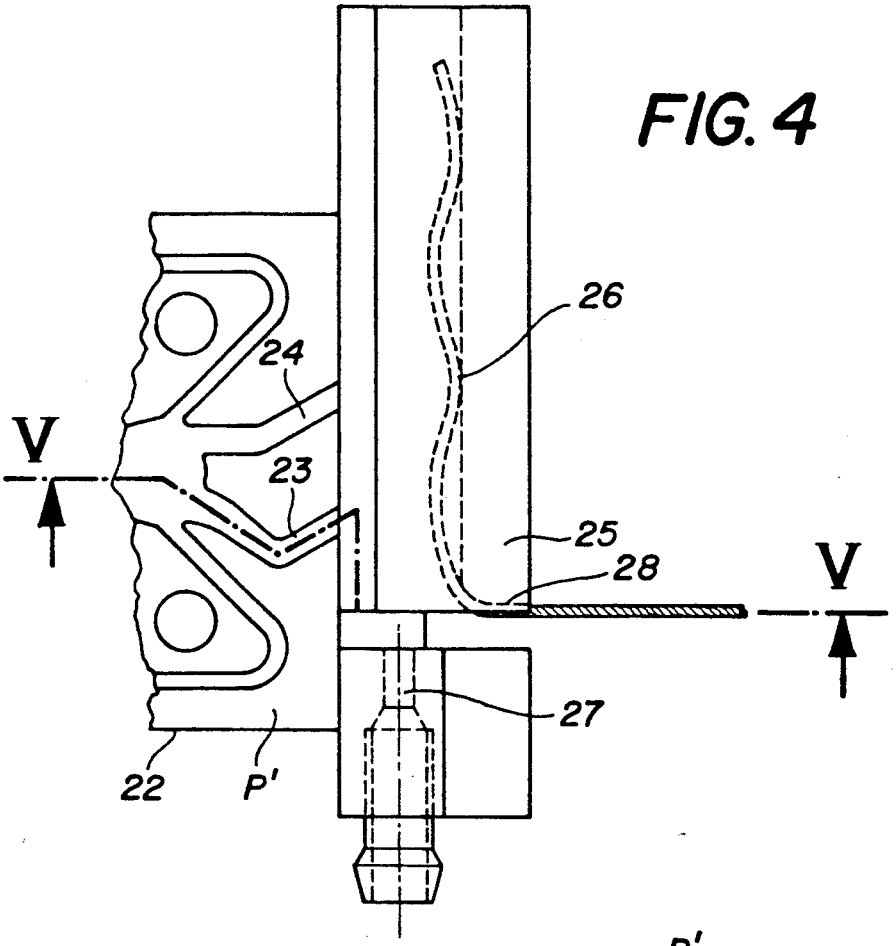
FIG. 4 is a view from above of the second embodiment.
Figure 5:
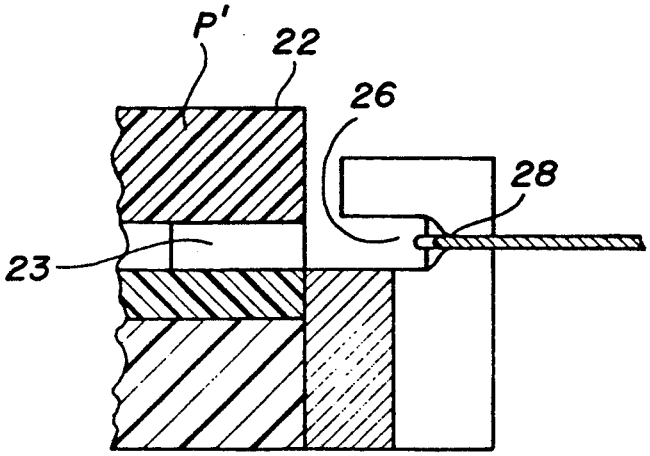
FIG. 5 is a cross-sectional view along line V—V of FIG. 4.

The second embodiment of the device illustrated by FIG. 4 also comprises an air-jet generator 22 involving a flip-flop fluid circuit. The concept of this air generator 22 is the same as that of the generator of FIG. 2, except for the orientation of the output nozzles 23, 24 which, instead of converging toward a point, have substantially parallel directions and are oriented slantwise to the face of the plate P' in which they open and which is adjacent to a longitudinal face of a block 25 of generally parallelipipede form. This block 25 is provided with a two open-end channel 26 which also has a side opening extending over its full length. The output nozzles 23, 24 open precisely in front of this side opening of channel 26 when the plate P' is positioned adjacent to this block 25.

A third nozzle 27 is located to face the upstream end of channel 26 and is oriented in parallel with the longitudinal axis thereof. A slot 28 for positioning the yarn is provided at an edge of the upstream end of channel 26.

In a first step, a certain length of thread, which corresponds to at least the average yarn fiber length, is introduced into channel 26 by the air jet spurting continuously from the third nozzle 27. Then, while maintaining this stream active all along the process, the flip-flop fluid circuit is started in order that air gushes be alternatively outflowing from the output nozzles 23, 24 at a frequency of about 1000 Hz for about 0.2 sec. These side jets impart to the thread an effect to be compared to pinching the thread at a point and displacing the pinching point axially toward the thread's end; this results into thread untwisting. Moreover, since the free end of the thread is under the effect of the axial air jet from nozzle 27, this end is not left uncontrolled and hence knot formation is avoided. The axial air jet also contributes to expel the fibers set free by the action of the pulsed jets issuing from nozzles 23, 24.

Experiments were carried out with this embodiment and the results showed that all the threads and yarns indicated in the previous Table can be loosened, unravelled and opened-up with the device represented in FIG. 4. Furthermore, it was also possible by using the device, to undo, unravel and open-up much finer cotton yarns, of metric deniers 50 and 70, spun by ring spinning. Yet, it is well known that the finer the thread, the more difficult it is to be untwisted.

Of course, other devices with two or three nozzles can be visualized. For instance, the device of FIG. 1 can be combined with a third axial nozzle, with or without a deflector 3 as said before. It is also possible to combine the flip-flop of FIG. 2 with the flip-flop of FIG. 4, i.e. orient the nozzles 5 and 6 at different angles so that the jets do not meet on the longitudinal axis of channel 1, but intersect with this axis at two different places as the jets from nozzles 23 and 24 do. An arrangement of this sort can be also advantageously combined with an axial, continuously operating, third nozzle.

We claim:

1. A universal method for loosening, unravelling and opening-up a textile yarn by placing the free end of this yarn in a pressurized, channelled air stream while holding the base of this free end in the upstream portion of this air stream, characterized in forming said air stream by means of at least two alternately interrupted air jets which are directed toward a longitudinal axis of a channelling element for said air stream, and wherein an alternating frequency of the air jets is on the order of several hundreds of Hz.

2. The method of claim 1, further characterized in that the at least two alternating jets are placed on the same side of a plane containing the longitudinal axis of said channelling element of said air stream and are oriented slantwise relative to the plane containing the longitudinal axis and the jets are substantially parallel to one another.

3. The method of claim 2, further characterized in that a third jet, operating continuously, is formed and oriented along the longitudinal axis of the channelling element of said air stream.

4. The method of claim 1, characterized in that said alternating air jets directed toward said longitudinal axis are located symmetrically with respect to a plane containing the axis of this channel.

5. The method of claim 4, in which said jets in alternating succession impart a swinging motion to the yarn, characterized in simultaneously deflecting sidewise the trajectory of this swinging motion.

* * * * *